US009093809B2

(12) United States Patent
Sanders et al.

(10) Patent No.: US 9,093,809 B2
(45) Date of Patent: Jul. 28, 2015

(54) THEFT DETERRENTS FOR SOLID STATE LAMPS

(71) Applicant: ABL IP HOLDING LLC, Conyers, GA (US)

(72) Inventors: Chad N. Sanders, Ashburn, VA (US); Steven S. Lyons, Herndon, VA (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 13/975,821

(22) Filed: Aug. 26, 2013

(65) Prior Publication Data

US 2015/0056834 A1 Feb. 26, 2015

(51) Int. Cl.
*H01R 33/97* (2006.01)

(52) U.S. Cl.
CPC ..... *H01R 33/97* (2013.01); *H01R 33/971* (2013.01)

(58) Field of Classification Search
CPC ..... H01R 33/97; H01R 33/971
USPC ..... 362/249.02
See application file for complete search history.

(56) References Cited

U.S. PATENT DOCUMENTS

| | | | | |
|---|---|---|---|---|
| 4,637,671 | A * | 1/1987 | Johnson et al. | 439/227 |
| 6,494,730 | B1 * | 12/2002 | Yan | 439/226 |
| 2002/0098731 | A1 * | 7/2002 | Varone et al. | 439/347 |
| 2009/0257220 | A1 * | 10/2009 | Lenk et al. | 362/186 |
| 2011/0175528 | A1 | 7/2011 | Rains, Jr. et al. | |
| 2011/0176291 | A1 | 7/2011 | Sanders et al. | |
| 2011/0176316 | A1 | 7/2011 | Phipps et al. | |
| 2011/0317438 | A1 * | 12/2011 | Erhard et al. | 362/382 |

* cited by examiner

*Primary Examiner* — Mary Ellen Bowman
(74) *Attorney, Agent, or Firm* — RatnerPrestia

(57) ABSTRACT

A lamp includes a bulb; a light source such as an LED; a lamp base including a connector for providing electricity from a standard lamp socket; and a housing coupled to the lamp base and supporting the bulb in a position to receive electromagnetic energy from the light source. Circuitry connected to receive electricity from the connector of the lamp base provides drive current to the light source. In the examples, each of the lamps also includes a theft deterrence mechanism coupled to the lamp base configured to deter unauthorized removal of the lamp once the lamp base has been inserted into the standard lamp socket to enable lamp operation.

20 Claims, 10 Drawing Sheets

THEFT DETERRENTS FOR SOLID STATE LAMPS

TECHNICAL FIELD

The present subject matter relates to techniques and equipment to deter theft of a solid state lamp.

BACKGROUND

Solid state lamps, such as may use light emitting diodes to enable the lamps to output visible light, are rapidly gaining in popularity. Such lamps are more energy efficient, for example, than traditional incandescent "light bulbs." As LED performance improves, solid state lamps increasingly provide a competitive alternative to compact florescent lamps (CFLs), for example, because solid state lamps can produce a better quality of light than most CFLs particularly low-cost CFLs, and because the solid state lamps are not subject to slow start-up or the flickering that may occur as a CFL ages. Furthermore, since there is no mercury in a solid state lamp, such a lamp is less toxic to the environment when disposed after usage, than is the case with a CFL that utilizes mercury vapor.

Solid state lighting (SSL) lamps are considered more valuable than standard incandescent and fluorescent lamps as a result of their longer lifespan and higher cost of goods to manufacture. As a result, SSL lamps are more prone to theft than traditional lamps.

Hence a need exists for either preventing or reducing opportunities for theft of SSL lamps.

SUMMARY

The concepts disclosed herein address the above noted problems with theft of SSL lamps.

In an example, a lamp comprises a bulb; a solid state source of light comprising one or more light emitting diodes (LEDs) configured to emit a electromagnetic energy to cause the lamp to produce as a visible output; and a lamp base including a connector for providing electricity from a standard lamp socket. A housing connected to the lamp base supports the bulb in a position to receive electromagnetic energy from the solid state source; circuitry connected to receive electricity from the connector of the lamp base and to provide drive current to the LEDs of the solid state source. In this example, the lamp also includes a theft deterrence mechanism, coupled to the lamp base, configured to deter unauthorized removal of the lamp once the lamp base has been inserted into the standard lamp socket to enable lamp operation.

According to another example, a lamp includes a bulb assembly including a bulb and a solid state source of light comprising one or more light emitting diodes (LEDs) contained within the bulb. A lamp base has a connector that is configured to be connected to a standard lamp socket. In this example, the lamp also has a theft deterrence mechanism associated with the lamp base that is moveable between a first position, in which the lamp can not readily be disconnected from the standard lamp socket, and a second position, in which the lamp can readily be disconnected from the standard lamp socket.

In yet another example, a lamp includes a bulb assembly including a bulb and a solid state source of light comprising one or more light emitting diodes (LEDs) contained within the bulb. Here, a lamp base includes a connector that is configured to be connected to a standard lamp socket. The connector of the lamp base is non-removable from the standard lamp socket once the lamp base has been connected to the standard lamp socket. The bulb assembly is configured to be removably connected to the lamp base such that once the lamp base has been connected to the standard lamp socket, the bulb assembly can be removed from the lamp base while the lamp base can not be easily removed from the standard lamp socket.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

Figure 1:
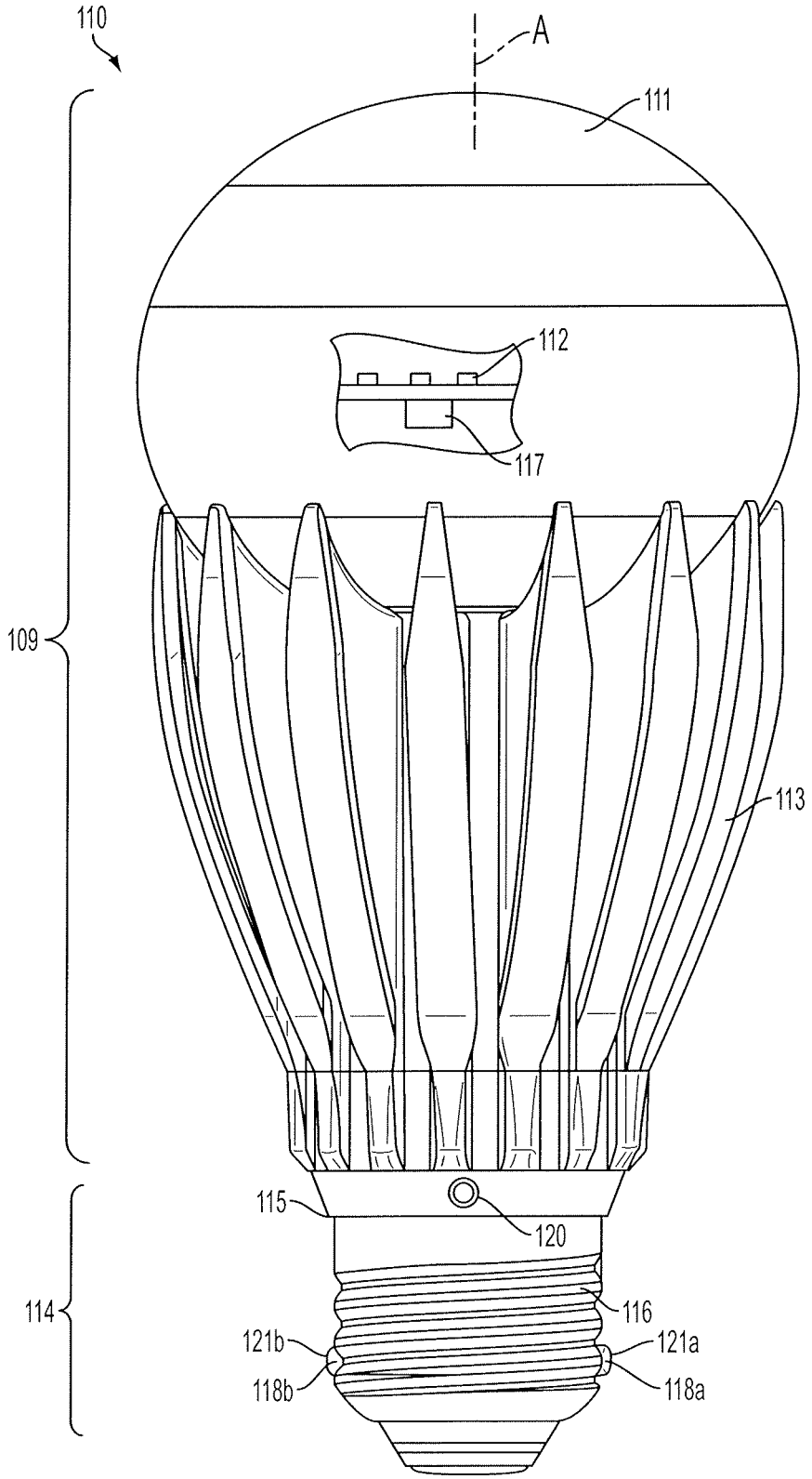
FIG. 1 depicts a front elevation view of an SSL lamp, according to a first example of a solid state lamp with a theft deterrence mechanism.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

As used herein, terms and phrase like "non-removable," "not removable," "not easily removed," and "not capable of being removed" generally mean that two structures are not capable of being separated by a typical user or customer without the use of tools or extraordinary force.

The various examples disclosed herein relate to an SSL lamp comprising a theft deterrence mechanism that is configured to deter unauthorized removal of the lamp once a lamp base of the lamp has been inserted into a standard lamp socket to enable lamp operation.

Reference now is made in detail to the examples illustrated in the accompanying drawings and discussed below.

FIGS. 1-5B depict a first example of an SSL lamp 110. The lamp 110 includes a bulb assembly 109 that is mounted to a base assembly 114. In this example and unlike the example of FIGS. 6-9, the bulb assembly 109 and the base assembly 114 are fixedly and non-removably connected together such that they are not capable of being readily disassembled by a typical user or customer without damage or destruction of the lamp.

Referring now to the features of the bulb assembly 109 of the lamp 110, the bulb assembly 109 generally includes a bulb 111, a solid state source of light comprising one or more light emitting diodes (LEDs) 112 positioned within the interior of the bulb 111, and a housing 113 having protruding heat sink fins that support the bulb 111 in a position to receive electromagnetic energy from the LEDs 112. The bulb 111 is shown partially cut away in FIG. 1 to reveal the LEDs 112, which are shown schematically in FIG. 1. Although shown mounted on a horizontal board or the like, for ease of illustration; the LEDs 112 may be mounted in any convenient way for ease of manufacture or to produce a desired distribution of light output from the bulb 111. For example, the LEDs 112 may be mounted on one or more lateral and end surfaces of a pedestal extending from the heat sink/housing 113 into the interior of the bulb 111 so as to provide an output distribution that a human might perceive as an approximation of the output distribution from a filament of an incandescent lamp.

The LED's 112 are configured to emit a electromagnetic energy, such as visible or ultraviolet light, that produces a visible light output of the lamp 110 via the bulb 111. If the LEDs emit visible light, some or all of that light may pass through the bulb for inclusion in the visible output. If the bulb utilizes a phosphor, the phosphor converts some of the energy from the LEDs to light in the visible spectrum for inclusion in the visible output through the bulb 111. The LEDs 112 may be mounted to the housing 113 either directly or indirectly such that the housing 113 acts as a heat sink or the like to substantially dissipate the thermal energy that is produced by the LEDs 112. It should be understood that the source of light described herein is not limited to LED's or any other source.

Circuitry 117, which is also shown schematically in FIG. 1, is connected to receive electricity from a connector 116 of the lamp base assembly 114 and to provide drive current to the LEDs 112 of the solid state source. The circuitry 117, for example, may be on a board that also supports the LEDs 112 as depicted by the schematic illustration; or the circuitry may be located elsewhere in the lamp 110, such as in the housing 113 and/or the lamp base 114.

Further details of examples of SSL lamp structures are described in U.S. Patent App. Pub. Nos. 2011/0175528, 2011/0176291 and 2011/0176316, which are each incorporated by reference herein in their entirety for any and all purposes.

Referring now to the features of the lamp base assembly 114 of the lamp 110, the base assembly 114 is fixedly and non-removably connected to the lower end of the housing 113 of the bulb assembly 109. The base assembly 114 includes a substantially cylindrical housing 115, and a connector 116 mounted to the lower end of the sidewall of the housing 115. The connector 116 includes industry-standard male threads for connecting to industry-standard female threads of a standard lamp socket. In use, the connector 116 provides electricity from a standard lamp socket (not shown). The base connector is not limited to the threaded connector that is shown and described, and may be any of a variety of standard lamp bases. Examples of standard size and type of lamp bases include an Edison base and a three-way lamp base of normal or Mogul size.

Figure 2:
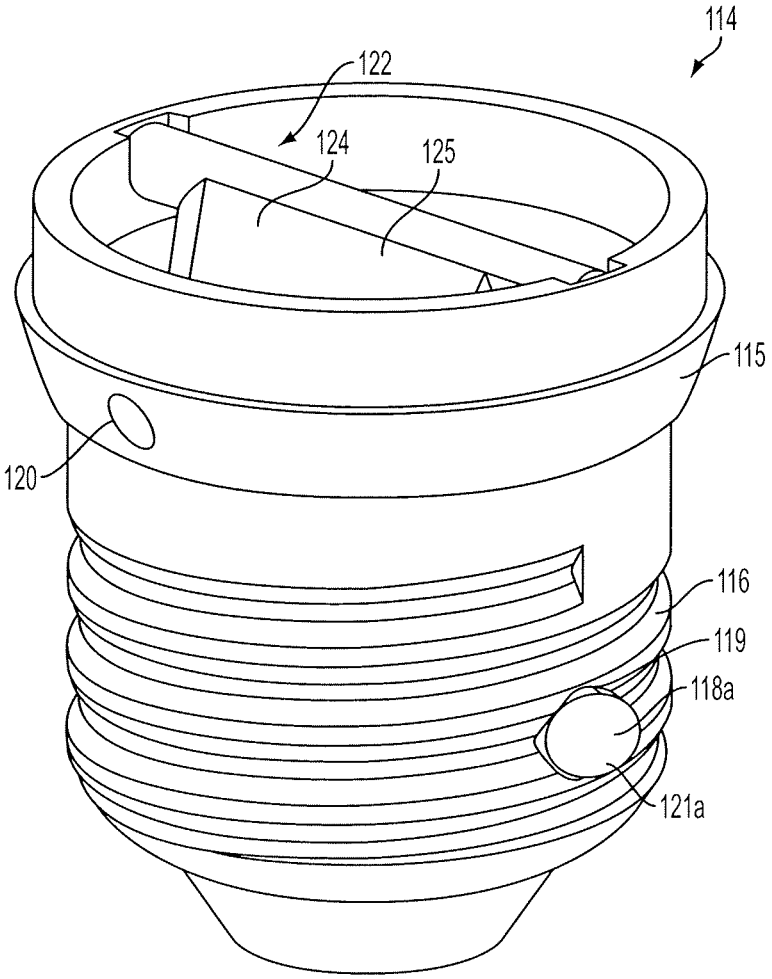
FIG. 2 depicts a front perspective view of a base assembly of the SSL lamp of FIG. 1.
Figure 5A:
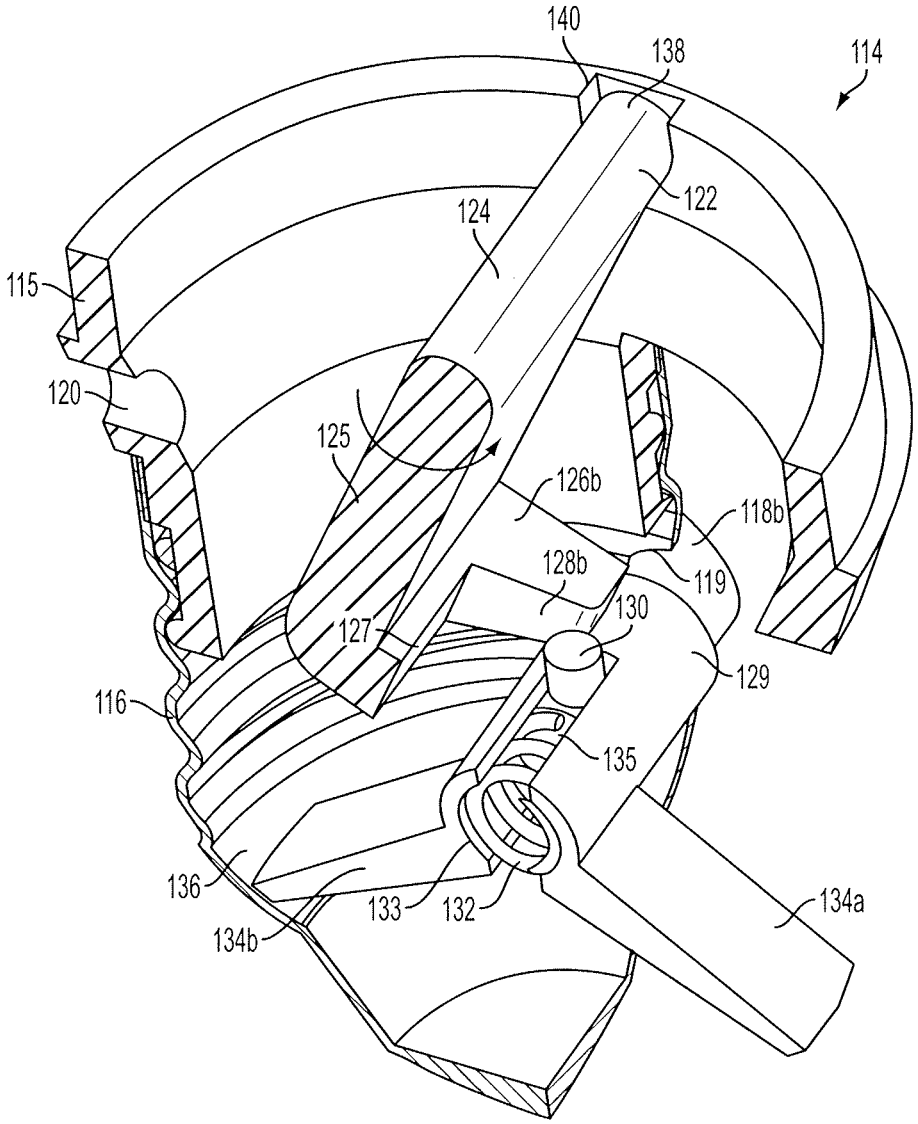
FIG. 5A is a partial cut-away perspective view of the lamp base assembly of FIG. 4, wherein locking pins on the lamp base assembly are shown in a deployed configuration in order to prevent removal of the bulb from the lamp base.

As best shown in FIGS. 2 and 5A, two holes 119 are provided on opposing sides of the threaded sidewall of the connector 116. The holes 119 are separated by 180 degrees. The holes 119 are provided to accommodate locking pins 121*a* and 121*b* (referred to collectively as locking pins 121) that are used to selectively lock the base assembly 114 to the standard lamp socket. The purpose of the locking pins 121 will be described with reference to the theft deterrence mechanism 122 of the lamp 110.

A hole 120 is provided on the sidewall of the base assembly 114 through which a tool 150 (see FIG. 5B) is inserted. The hole 120 is separated from both holes 119 by 90 degrees, for example. With the example of the theft deterrent mechanism as in these first drawings, the hole 120 is positioned at an elevation above the connector 116 such that the hole 120 is visible and accessible when the lamp 110 is connected to a connector of a standard lamp socket. In use, the tool 150 is positioned through the hole 120 to move the theft deterrence mechanism 122 to a release position, thereby permitting removal of the lamp 110 from the lamp socket. The tool 150 and the hole 120 may be configured so that removal of the lamp 110 can only be readily accomplished using the tool 150, and can not be easily removed with a pin or paper clip, for example.

Figure 4:
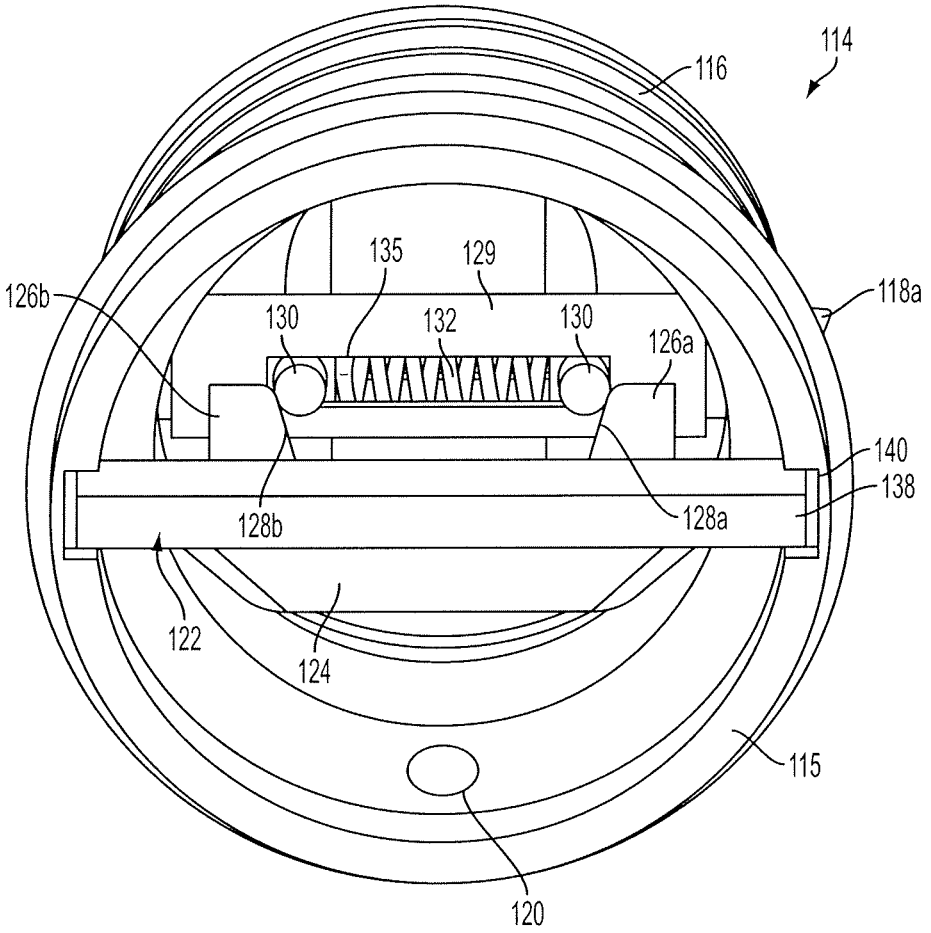
FIG. 4 depicts a top perspective view of the lamp base assembly of FIG. 2.
Figure 5B:
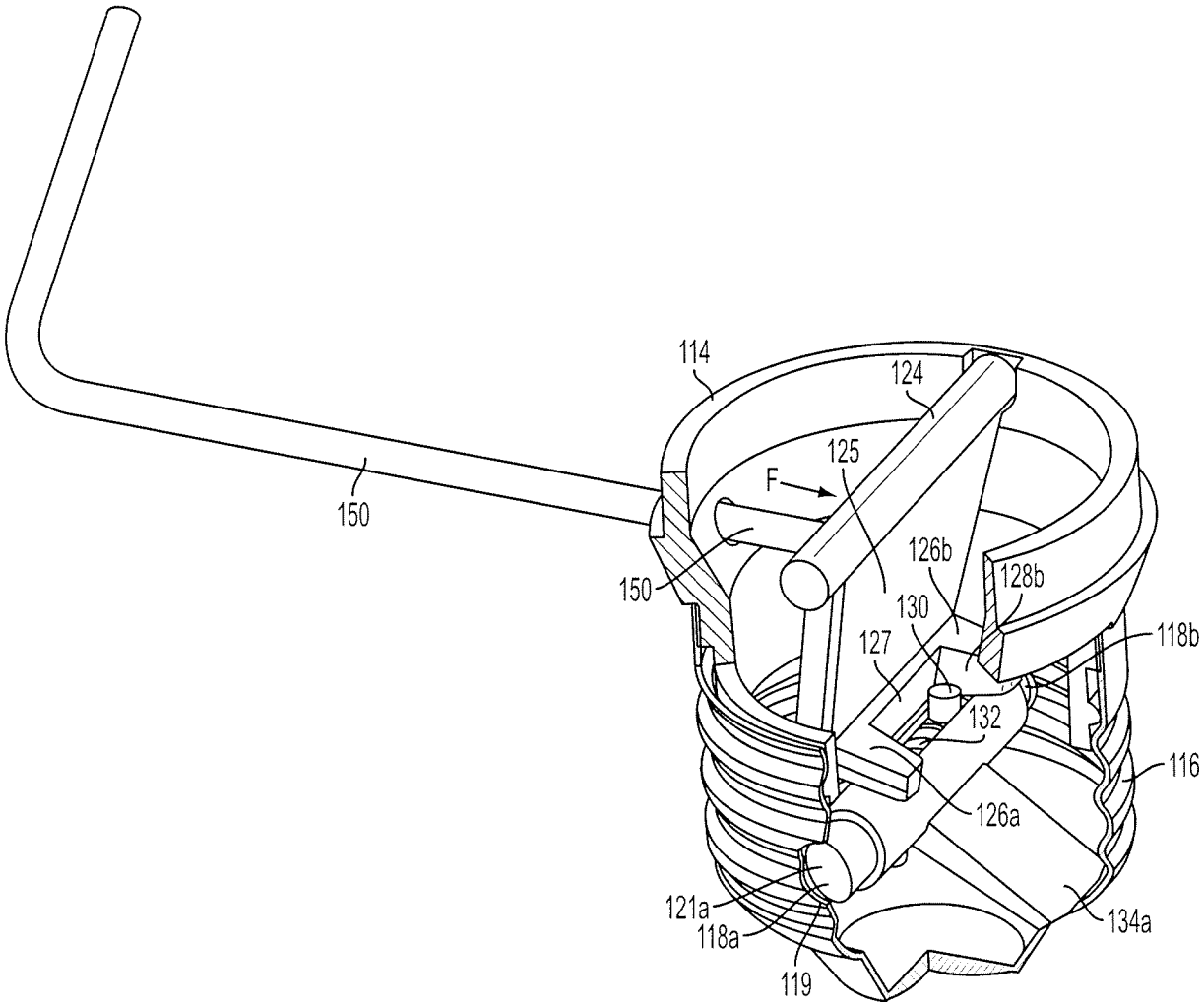
FIG. 5B is a partial cut-away perspective view of the lamp base assembly of FIG. 4 and a tool applied to the lamp base assembly, wherein the locking pins are shown in a retracted configuration in order to permit removal of the bulb from the lamp base.
Figure 6:
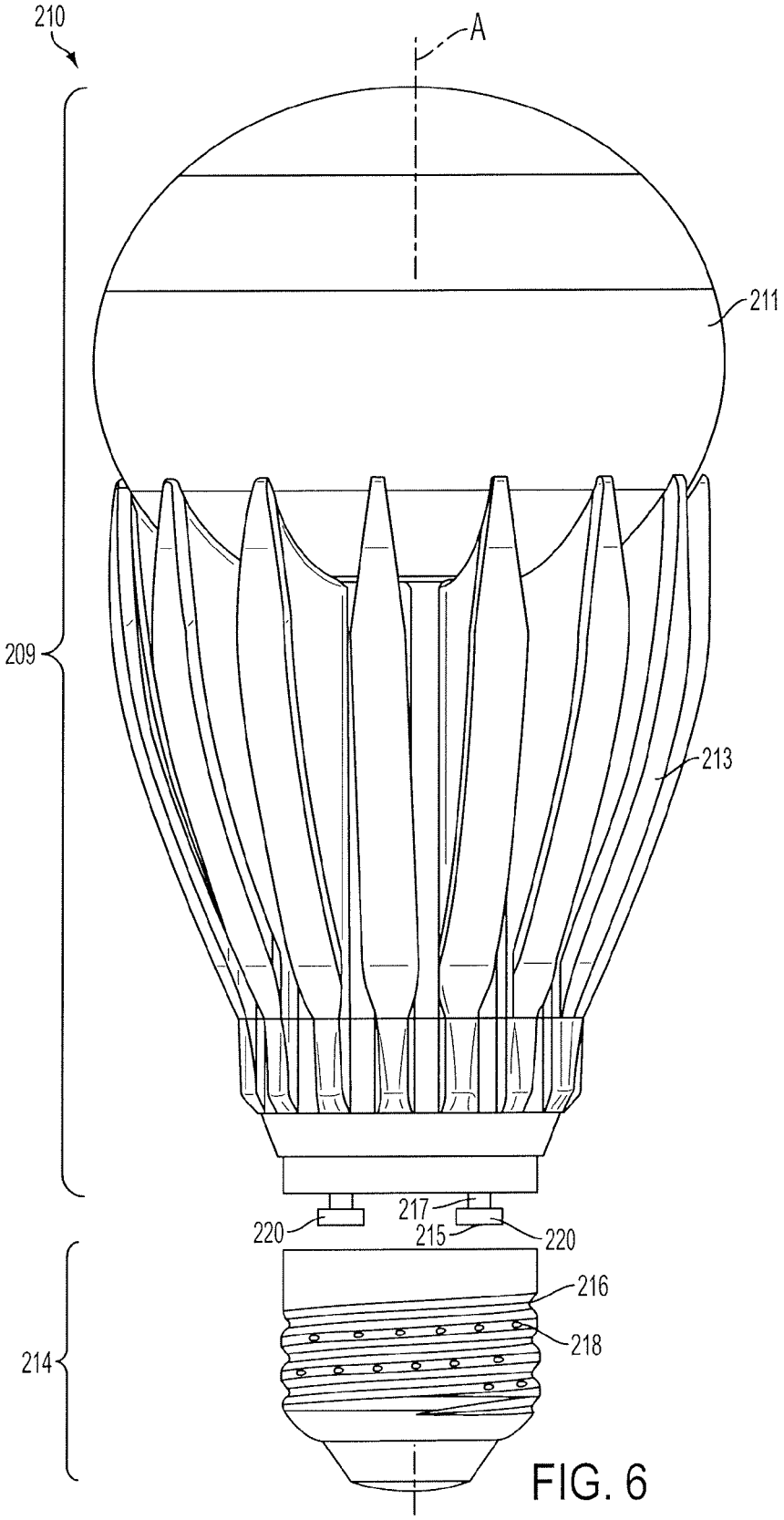
FIG. 6 depicts a front elevation view of an SSL lamp, according to a second example, wherein the SSL lamp is shown partially exploded.
Figure 7:
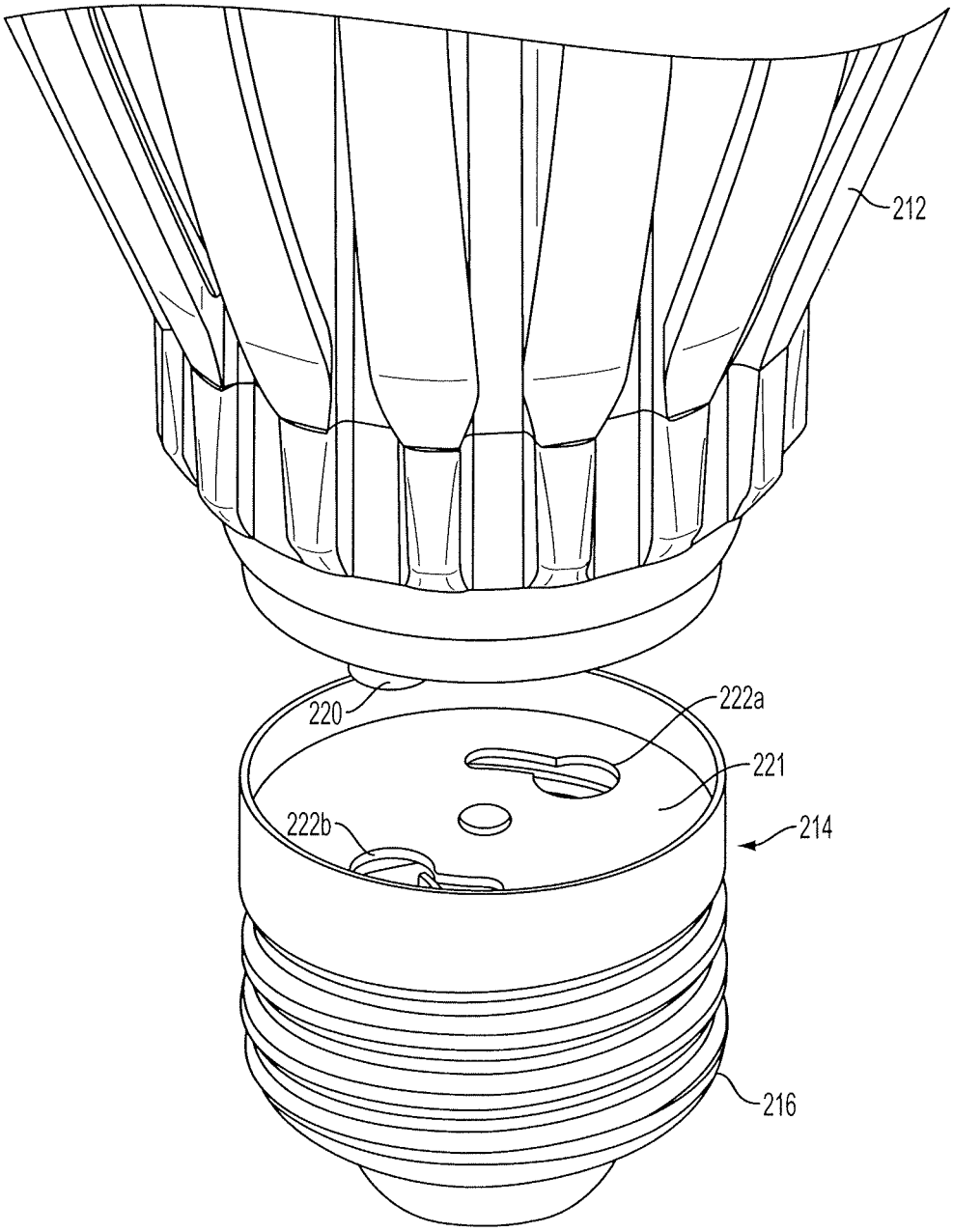
FIG. 7 depicts a detailed front perspective view of the partially exploded lamp of FIG. 6.
Figure 8:
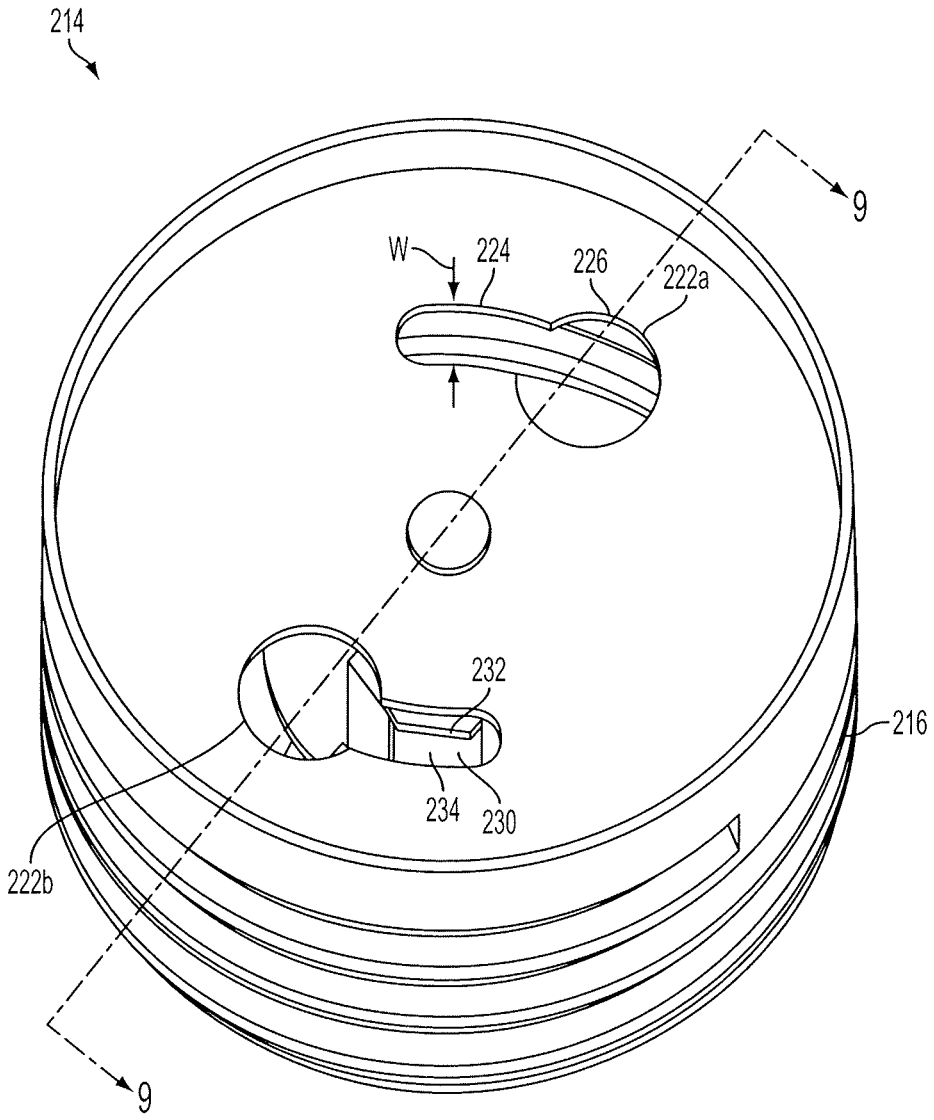
FIG. 8 depicts a top perspective view of a base assembly of the SSL lamp of FIG. 6.
Figure 9:
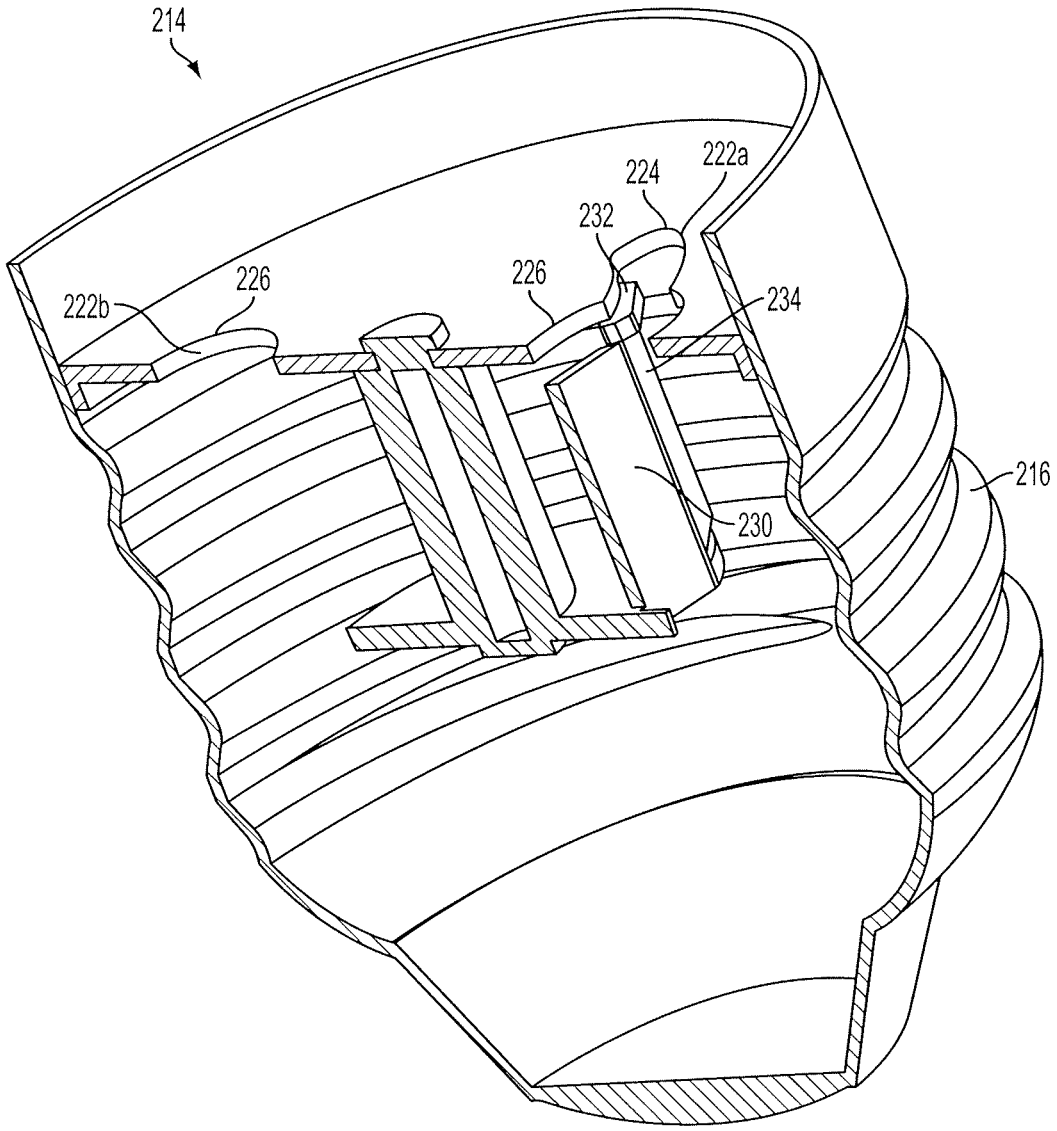
FIG. 9 is a cross-sectional perspective view of the lamp base assembly of FIG. 8 taken along the lines 9-9 in FIG. 8.

Referring now to the components of the theft deterrence mechanism 122 shown in FIGS. 4, 5A and 5B, the theft deterrence mechanism 122 is coupled to the lamp base assembly 114 to deter unauthorized removal of the lamp 110 once the lamp base assembly 114 has been connected to a standard lamp socket (not shown). The theft deterrence mechanism 122 is ordinarily maintained in the locked position shown in FIG. 5A, and a tool 150 is employed to move the theft deterrence mechanism 122 to the release position that is shown in FIG. 5B.

The theft deterrence mechanism 122 generally includes a lever 124 that interacts with two moveable and spring-loaded locking pins 121*a* and 121*b* (referred to collectively as pins 121) that are contained within a sleeve 129. The lever 124 of the theft deterrence mechanism 122 includes a substantially rectangular body 125. Two arms 138 extend from opposing sides of the top surface of the body 125. The arms 138 are positioned in respective slots 140 that are formed on the top edge of the base assembly 114. The arms 138 are capable of rotating within their respective slots 140 such that the arms 138 define the pivot axis of the lever 124.

Two legs 126*a* and 126*b* extend from opposing sides of the bottom surface of the lever body 125. The legs 126*a* and 126*b* include angled surfaces 128*a* and 128*b* (referred to collectively as angled surfaces 128), respectively. An internal angle of about 120 degrees, for example, is defined between each angled surface 128 and the planar surface 127 of the lever 124. The angled surfaces 128*a* and 128*b* of the lever 124 cooperate with posts 130 on the locking pins 121*a* and 121*b*, respectively, to cause translation of the locking pins 121 relative to the connector 116.

The sleeve 129 of the theft deterrence mechanism 122 includes a cylindrical body defining a through hole 133 at its center. The locking pins 121 are both translatably, yet captively, positioned in the hole 133. A spring 132 is positioned in the hole 133 between the locking pins 121 to bias the locking pins 121 outward and in opposite radial directions. A longitudinal slot 135 is formed at the top of the cylindrical body of the sleeve 129 to guide translation of the locking pin posts 130. The terminal ends of the slot 135 captivate the locking pins 121 in the hole 133 of the sleeve 129. According to this exemplary embodiment, the slot 135 of the sleeve 129 also prevents the locking pins 121 from rotating within the sleeve 129.

Two legs 134*a* and 134*b* (referred to collectively as legs 134) extend downwardly from the cylindrical body of the sleeve 129. The legs 134 are separated by an internal angle of about 120 degrees, for example. The legs 134 are positioned in an annular channel 136 defined on the interior surface of the base assembly 114. The sleeve 129 is retained in the base assembly 114 by the legs 134 and the locking pins 121 that are held captive, yet moveable, in their respective holes 119. Although not shown, the sleeve 129 may be integrated with either the connector 116 or the housing 115.

Figure 3:
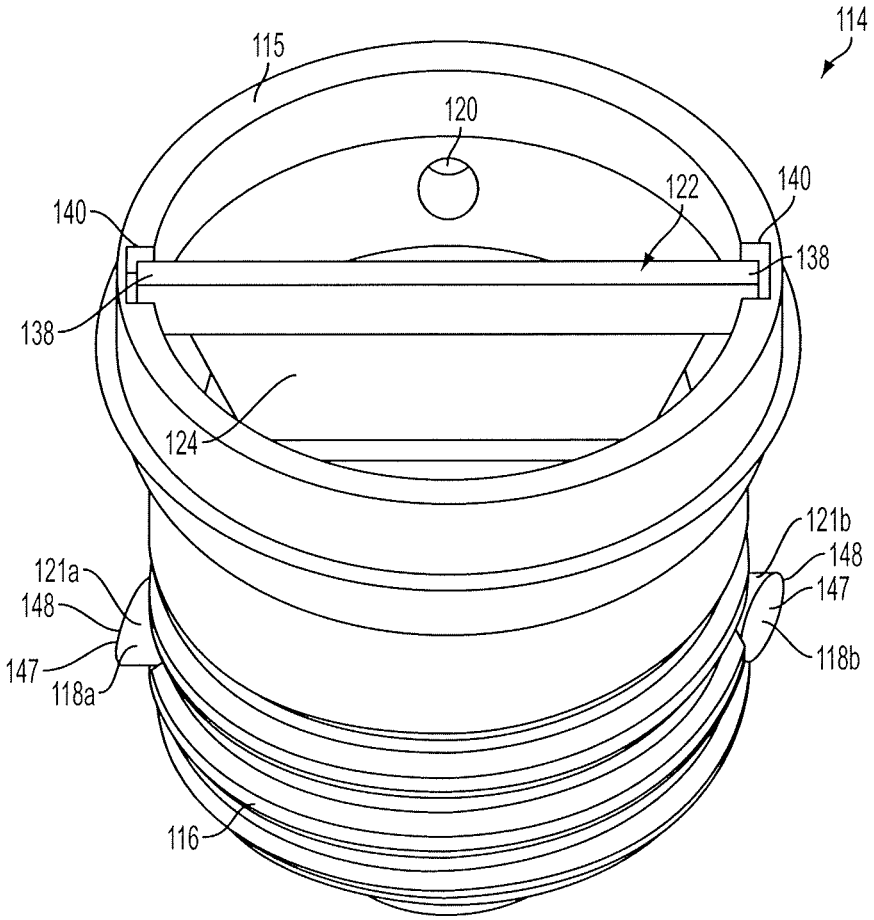
FIG. 3 depicts a rear perspective view of the lamp base assembly of FIG. 2.

The theft deterrence mechanism 122 also includes two locking pins 121*a* and 121*b* for selectively locking the lamp 110 to the connector of a standard lamp socket to deter removal of the lamp 110 from the lamp socket. Each locking pin 121 of the theft deterrence mechanism 122 includes a barb 118 that is configured to pass through a respective hole 119 in the threaded sidewall of the base assembly 114 to engage the connector of a standard lamp socket. As best shown in FIG. 3, each barb 118 includes an angled surface 147. The angled surface 147 is configured to slide along the connector of the standard lamp socket as the connector 116 is rotated in a clockwise direction (i.e., the attachment direction), and bind on the connector of the standard lamp socket as the connector 116 is rotated in a counterclockwise direction (i.e., the detachment direction).

More particularly, upon rotation of the connector 116 in a clockwise direction (i.e., the attachment direction), the locking pins 121 move inwardly into their respective holes 119 against the force of the spring 132, thereby permitting the lamp 110 to be connected to the connector of the standard lamp socket (not shown). As the connector 116 is rotated in the attachment direction, the angled surface 147 of each locking pin 121 merely slides along the threads of the connector of the standard lamp socket.

Upon rotation of the connector 116 in a in a counterclockwise direction (i.e., the detachment direction), however, the sharp end 148 of the angled surface 147 binds against the threaded surface of the connector of the standard lamp socket (not shown) to prevent detachment of the connector 116 (and, thus, the lamp 110) from the connector of the standard lamp socket. Once connected to the standard lamp socket, it may not be possible to detach the connector 116 (and, thus, the lamp 110) without using the tool 150 that is shown in FIG. 5B.

Referring still to FIGS. 4, 5A and 5B, each locking pin 121 also includes a cylindrical post 130 that is moveably positioned within the slot 135 of the sleeve 129. The posts 130 of the locking pins 121 moveably interact with the angled surfaces 128 of the lever 124. It should be understood that movement of the posts 130 results in movement of the barbs 118 with respect to the connector 116. More particularly, applying a force 'F' (see FIG. 5B) to the lever 124 causes the lever 124 to rotate, which causes the locking pin posts 130 to ride down the angled surfaces 147 of the lever 124 and translate inwardly (by virtue of the angle of the surfaces 147) toward the longitudinal axis 'A.' Upon removal of the force 'F', the spring 132 pushes the pins 121 outwardly and away from the longitudinal axis 'A,' which causes the locking pin posts 130 to ride up the angled surfaces 128 of the lever 124, which causes the lever 124 to rotate back to its position shown in FIG. 5A.

It should be understood that the post 130 and the barb 118 of each locking pin 121 are integrally formed thereon, thus, the post 130 and the barb 118 translate together. The post 130 and the barb 118, however, could be separate components. Also, although two locking pins 121 are shown and described herein, it should be understood that the theft deterrence mechanism 122 may include any number of locking pins 121.

According to one exemplary method of installing the lamp 110, the connector 116 of the lamp 110 is attached to the standard lamp socket in the usual way. More particularly, the connector 116 of the lamp 110 is rotated onto the female threads of the standard lamp socket in a clockwise direction. The angled surface 147 of each locking pin 121 merely slides along the threads of the connector of the standard lamp socket as the connector 116 is rotated onto the threads of the standard lamp socket in the clockwise direction. Each locking pin 121 may translate slightly within its respective hole 119 and slot 135 in a direction toward the longitudinal axis 'A' of the lamp 110 against the force of the spring 132 as the angled surface 147 of each locking pin 121 slides along the threads of the standard lamp socket.

By virtue of the force of the spring 132, the edges 148 of the locking pin barbs 118 bear on the female threads of the standard lamp socket. The friction contact between the edges 148 of the locking pin barbs 118 and the female threads of the standard lamp socket prevents counterclockwise rotation of each pin 121 with respect to the female threads of the lamp socket. If a user were to attempt to rotate the lamp 110 in a counterclockwise rotation without using the tool 150, the edge 148 of each pin 121 would wedge against the female threads of the lamp socket to prevent counterclockwise rotation of the connector 116, and, thus, prevent removal of the lamp 110 from the standard lamp socket.

Referring still to FIGS. 5A and 5B, to detach the lamp 110 from the standard lamp socket, a tool 150 must first be inserted in the hole 120. The end of the tool 150 is pushed against the body 125 of the lever 124, as shown in FIG. 5B, causing the lever 124 to rotate about its arms 138. Rotation of the lever 124 in the direction of the curved arrow in FIG. 5A causes the angled surfaces 128 of the lever 124 to bear on and simultaneously translate the posts 130 of the pins 121 within their respective slots 135 in a direction toward the longitudinal axis 'A' of the lamp 110 and against the force of the spring 132. The barbs 118 move toward the longitudinal axis 'A' of the lamp 110 along with the posts 130, thereby disengaging the barbs 118 from the female threads of the standard lamp socket (not shown). Thereafter, the connector 116 (along with the rest of the lamp 110) can be manually rotated in a counterclockwise direction (i.e., the detachment direction) to remove the entire lamp 110 from the standard lamp socket. The tool 150 is removed from the lamp 110 once the connector 116 of the lamp 110 becomes detached from the female threads of the standard lamp socket.

FIGS. 6-9 depict a second example of a lamp 210 with theft deterrence. The lamp 210 of FIGS. 6-9 is substantially similar to the lamp 110 of FIGS. 1-5B, and only the differences between those lamps will be described hereinafter.

The lamp 210 includes a bulb assembly 209 that is mounted to a base assembly 214. According to this exemplary embodiment and unlike the embodiment shown in FIGS. 1-5B, the bulb assembly 209 and the base assembly 214 are releasably connected together.

Referring now to the features of the bulb assembly 209 of the lamp 210, the bulb assembly 209 generally includes a bulb 211, a solid state source of light comprising one or more LEDs (not shown) positioned within the interior of the bulb 211, and a housing 213 having protruding heat sink fins that supports the bulb 211 in a position to receive electromagnetic energy from the LEDs.

The housing 213 includes two prongs 220 that extend from and are fixed to its lower surface. The prongs 220 are electrically and mechanically connected to the circuitry and LEDs in the bulb 211. Each prong includes a large diameter portion 215 at its free end having a first diameter, and a small diameter portion 217 at its fixed end having a second diameter that is smaller than the first diameter. The prongs 220 are configured to be releasably connected to the base assembly 214 to enable connection and disconnection of the housing 213 from the base assembly 214. It should be understood that the prongs 220 are not removable from the housing 213.

Referring now to the features of the lamp base assembly 214 of the lamp 210, the base assembly 214 is releasably connected to the lower end of the housing 213 of the bulb assembly 209 by the prongs 220. The base assembly 214 includes a substantially cylindrical housing having a connector 216 on its sidewall. The connector 216 includes industry-standard male threads for connecting to industry-standard female threads of a standard lamp socket. In use, the connector 216 provides electricity from a standard lamp socket (not shown).

A plurality of triangular-shaped barbs 218 are formed in the male threads of the connector 216 by a punching operation, for example. The barbs 218 protrude outwardly from the connector 216, and away from the longitudinal axis 'A' of the lamp 210. In use, the barbs 218 permit the connector 216 to be screwed in a clockwise direction onto the threads of a standard lamp socket. Once the connector 216 is connected to the lamp socket, however, the sharp tip of the triangular-shaped barbs 218 dig into the threads of the lamp socket, thereby preventing removal of the connector 216 from the lamp socket. Thus, the barbs 218 may be considered as a theft deterrence mechanism for the lamp 210.

The theft deterrence mechanism is not limited to the barbs 218 that are shown and described herein. The theft deterrence mechanism may be any mechanism that both permits connection and prevents disconnection of the base assembly 214 to the lamp socket. By way of non-limiting example, the theft deterrence mechanism may be a fastener, a latch, a lock, an adhesive, a magnet, a ratchet, a mechanical thread, a clip, a clamp, a pin, a detent, a spring, a surface, a tab, a tie, a recess, a prong or a barb.

A wall 221 is defined at the top end of the base assembly 214. Two slots 222*a* and 222*b* (referred to either individually or collectively as slots 222) are formed in the wall 221. Each slot 222 is configured to releasably receive a respective prong 220 of the bulb assembly 209. The slots 222 are spaced apart by the same distance as the prongs 220. Each slot 222 includes a large diameter opening 226 for initially receiving a large diameter portion 215 of a respective prong 220, and a channel 224 extending from the large diameter opening 226 for accommodating the small diameter portion 217 of the respective prong 220, as will be described later.

The width 'W' of the channel 224 is less than the diameter of the large diameter opening 226, and slightly larger than the diameter of the small diameter portion 217 of the prong 220 to create a mechanical interference fit and establish electrical continuity between the base assembly 114 and the prong 220.

An electrical contact 230, which is formed of a conductive material, is mounted beneath the wall 221 of the base assembly 214 to reside within the interior space of the base assembly 214. The electrical contact 230 serves two purposes, i.e., it establishes an electrical contact between the base assembly 214 and a prong 220 of the bulb assembly 209, and it prevents the prong 220 (along with the bulb assembly 209) from inadvertently detaching from the base assembly 214 once connected.

The electrical contact 230 includes a shoulder 232 under which the large diameter portion 215 of the prong 220 is positioned when the prong 220 is positioned in the channel 224 of the slot 222*a*. The large diameter portion 215 of the prong 220 is sandwiched between the shoulder 232 and the wall 214 to prevent the prong 220 (along with the bulb assembly 209) from inadvertently detaching from the base assembly 214. The large diameter portion 215 of the prong 220 contacts a wall 234 of the electrical contact 230 to conduct electricity from the connector 216 to the prong 220. Although not shown, another wall 234 having a shoulder 232 may be positioned beneath slot 222*b*.

According to one exemplary method of installing the lamp 210, the bulb assembly 209 is first connected to the base assembly 214. To connect the bulb assembly 209 to the base assembly 214, the large diameter portions 215 of the prongs 220 are positioned through the large diameter openings 226 of the slots 222. The prongs 220 can be positioned in either slot 222. The bulb assembly 209 is then rotated in a counterclockwise direction to rotate the prongs 220 through the slots 222. Once rotated, the small diameter portions 217 of the prongs 220 are positioned in the channels 224 of the slots 222, and the large diameter portion 215 of one of the prongs 220 is sandwiched between the shoulder 232 of the electrical contact 230 and the wall 214 to prevent the prong 220 (along with the bulb assembly 209) from inadvertently detaching from the base assembly 214. Neither the slots 222 nor the prongs 220 are visible once the bulb assembly 209 is connected to the base assembly 214.

Thereafter, the connector 216 of the lamp 210 is attached to the standard lamp socket in the usual way. More particularly, the connector 216 of the lamp 210 is rotated onto the female threads of the standard lamp socket in a clockwise direction. The sharp end of each barb 218 slides along the threads of the connector of the standard lamp socket as the connector 216 is rotated onto the threads of the standard lamp socket in the clockwise direction.

Once installed, rotating the lamp 210 in a counterclockwise direction would cause the bulb assembly 209 to detach from the base assembly 214, while the base assembly 214 would remain connected to the female threads of the lamp socket. More particularly, the friction contact between the sharp tip of each barb 218 and the female threads of the standard lamp socket prevents counterclockwise rotation of the connector 216 with respect to the female threads of the lamp socket. If a user were to attempt to rotate the base assembly 214 in a counterclockwise rotation, the sharp tip of the barb 218 would dig into the female thread of the lamp socket to prevent counterclockwise rotation of the connector 216, and, thus, prevent removal of the lamp 210 from the standard lamp socket.

Unlike the lamp 110 of FIGS. 1-5B, no tool exists to remove the base assembly 214 from the lamp socket. The base assembly 214 is permanently connected to the lamp socket once it is installed. While the bulb assembly 209 may be removed from the base assembly 214, as was described, the bulb assembly 209 can not be used without the mating base assembly 214, and would be worthless.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A lamp, comprising:

a bulb;

a solid state source of light comprising one or more light emitting diodes (LEDs) configured to emit a electromagnetic energy to cause the lamp to produce as a visible output via the bulb;

a lamp base defining an interior space and including a connector for providing electricity from a standard lamp socket;

a housing connected to the lamp base and supporting the bulb in a position to receive electromagnetic energy from the solid state source;

circuitry connected to receive electricity from the connector of the lamp base and to provide drive current to the LEDs of the solid state source; and a theft deterrence mechanism positioned at least partially within the interior space of the lamp base and configured to deter unauthorized removal of the lamp once the lamp base has been inserted into the standard lamp socket to enable lamp operation.

2. The lamp of claim 1, wherein the theft deterrence mechanism comprises:

a barb that extends from the connector of the lamp base, and the barb is configured to permit connection between the connector of the lamp base and a connector of the standard lamp socket, and, once connected, prevent disconnection of the connector of the lamp base and the connector of the standard lamp socket.

3. The lamp of claim 2, wherein:

the barb is moveable between a first position and a second position, in the first position of the barb, the barb is engaged with threads of the standard lamp socket to prevent movement of the connector of the lamp base with respect to the standard lamp socket, and in the second position of the barb, the barb is not engaged with threads of the standard lamp socket to permit movement of the connector of the lamp base with respect to the standard lamp socket.

4. The lamp of claim 1, wherein the housing is fixedly and non-removably connected to the lamp base.

5. The lamp of claim 1, wherein the housing is releasably connected to the lamp base.

6. The lamp of claim 5, further comprising:

one of a slot and a prong provided on the lamp base and the other of the slot and the prong provided on the housing, wherein the prong is configured to be releasably connected in the slot to enable connection and disconnection of the lamp base to and from the housing.

7. A lamp, comprising:

a bulb assembly including a bulb and a solid state source of light comprising one or more light emitting diodes (LEDs) contained within the bulb; and a lamp base defining an interior space and including:

a connector that is configured to be connected to a standard lamp socket, and a theft deterrence mechanism positioned at least partially within the interior space of the lamp base that is moveable between a first position, in which the lamp can not readily be disconnected from the standard lamp socket, and a second position, in which the lamp can readily be disconnected from the standard lamp socket.

8. The lamp of claim 7, wherein:

the theft deterrence mechanism comprises a moveable barb positioned on the connector of the lamp base, in the first position of the theft deterrent mechanism, the barb is engaged with threads of the standard lamp socket to prevent movement of the connector of the lamp base with respect to the standard lamp socket, and in the second position of the theft deterrent mechanism, the barb is not engaged with the threads of the standard lamp socket to permit movement of the connector of the lamp base with respect to the standard lamp socket.

9. The lamp of claim 8, wherein:

the theft deterrence mechanism further comprises a moveable lever that is connected to the barb, and movement of the lever causes the barb to move between the first and second positions.

10. The lamp of claim 9, wherein the lever is positioned within the lamp base, and the lamp base includes an opening through which a tool can be inserted to move the lever.

11. The lamp of claim 9, wherein:

the lever includes an angled surface, a segment of the barb that is positioned within the lamp base includes an angled surface, and the angled surface of the lever is configured to bear on the angled surface of the barb to move the barb between the first position and the second position.

12. The lamp of claim 8, wherein the barb is biased by a spring toward the first position.

13. The lamp of claim 7, wherein the bulb assembly is fixedly and non-removably connected to the lamp base.

14. A iamb, comprising:

a bulb assembly including a bulb and a solid state source of light comprising one or more light emitting diodes (LEDs) contained within the bulb; and a lamp base including a connector that is configured to be connected to a standard lamp socket, the connector of the lamp base being non-removable from the standard lamp socket once the lamp base has been connected to the standard lamp socket, wherein the bulb assembly is configured to be removably connected to the lamp base such that once the lamp base has been connected to the standard lamp socket, the bulb assembly can be removed from the lamp base while the lamp base can not be easily removed from the standard lamp socket.

15. The lamp of claim 14 further comprising:

at least one barb that extends from the connector of the lamp base, wherein the barb is configured to permit connection between the connector of the lamp base and a connector of the standard lamp socket, and, once connected, the barb is configured to prevent disconnection of the connector of the lamp base from the connector of the standard lamp socket.

16. The lamp of claim 15, wherein:

the connector of the lamp base comprises male threads for connecting with female threads of the standard lamp socket, and the at least one barb extends outwardly from the male threads.

17. The lamp of claim 14 further comprising:

one of a slot and a prong provided on the lamp base and the other of the slot and the prong provided on the bulb assembly, wherein the prong is configured to be releasably connected in the slot to enable connection and disconnection of the lamp base to and from the bulb assembly.

18. The lamp of claim 17, wherein the slot is provided on the lamp base and the prong is provided on the bulb assembly.

19. The lamp of claim 17, wherein neither the slot nor the prong are visible once the bulb assembly is connected to the lamp base.

20. The lamp of claim 17 further comprising:

an electrical contact positioned within the lamp base for contacting the prong once the bulb assembly is connected to the lamp base, wherein the electrical contact is configured to retain the bulb assembly fixed in position once the lamp base is connected to the bulb assembly.

* * * * *